US006186033B1

(12) United States Patent
Faro, Sr.

(10) Patent No.: US 6,186,033 B1
(45) Date of Patent: Feb. 13, 2001

(54) MULTI-POSITIONAL TURNING TOOL

(76) Inventor: Daniel A. Faro, Sr., 4010 3rd St., Baltimore, MD (US) 21225

( * ) Notice: Under 35 U.S.C. 154(b), the term of this patent shall be extended for 0 days.

(21) Appl. No.: 09/302,507

(22) Filed: Apr. 30, 1999

(51) Int. Cl.[7] ..... B25B 23/16
(52) U.S. Cl. ..... 81/177.7; 81/177.6
(58) Field of Search ..... 81/125.1, 177.1, 81/177.2, 177.6, 177.7, 177.75, 177.8, 177.85

(56) References Cited

U.S. PATENT DOCUMENTS

| | | | | |
|---|---|---|---|---|
| 1,395,888 | * | 11/1921 | Ayotte | 81/177.2 |
| 1,448,962 | * | 3/1923 | Hughes | 81/177.7 |
| 1,454,789 | * | 5/1923 | Rentchler | 81/177.6 |
| 1,903,660 | * | 4/1933 | Smith et al. | 81/177.6 |
| 2,501,217 | * | 3/1950 | Hawn | 81/177.6 |
| 2,921,773 | * | 1/1960 | Hoelzer | 81/177.8 |
| 3,002,409 | * | 10/1961 | Jones | 81/177.2 |
| 3,779,107 | * | 12/1973 | Avery | 81/177.8 |
| 3,996,821 | * | 12/1976 | Murray | 81/177.2 |
| 4,461,192 | * | 7/1984 | Suligoy et al. | 81/177.8 |
| 4,730,960 | * | 3/1988 | Lewis et al. | 408/127 |
| 5,280,740 | * | 1/1994 | Ernst | 81/177.7 |
| 5,392,673 | * | 2/1995 | Scott | 81/177.2 |
| 5,433,548 | * | 7/1995 | Roberts et al. | 403/74 |
| 5,471,899 | * | 12/1995 | Twomlow | 81/60 |
| 5,517,884 | * | 5/1996 | Sanders | 81/60 |
| 5,647,622 | * | 7/1997 | Schectman | 294/19.1 |
| 5,680,800 | * | 10/1997 | Sharpe | 81/177.2 |
| 5,862,723 | * | 1/1999 | Rowlands | 81/177.9 |
| 5,943,925 | * | 8/1999 | Huang | 81/177.2 |

* cited by examiner

*Primary Examiner*—David A. Scherbel
*Assistant Examiner*—David B. Thomas
(74) *Attorney, Agent, or Firm*—Richard L Huff

(57) ABSTRACT

A wrench with interchangeable, pivotal, rotatable tool pieces on at least one end. A snap-on tool piece, preferably a wrench, fits into a pivotal end piece which is pivotably held to an extension arm by a toothed pin in toothed apertures. The extension arm is pivotably attached to a rotating shaft by toothed pins. There may be another pivotable snapon connection for a tool piece at the opposite end of the shaft. As an alternative, the tool piece fits into a pivotable end piece which is positioned at the end of a pivotably segmented shaft which fits inside the casing and handle of the tool. The location of the tool piece in relation to the handle may be easily set and secured. The multiplicity of possible tool pieces and positions makes this tool highly versatile and capable of reaching into hard-to-reach areas. Thus, bolts in car motors may be reached without having to partially dismantle the motor.

16 Claims, 11 Drawing Sheets

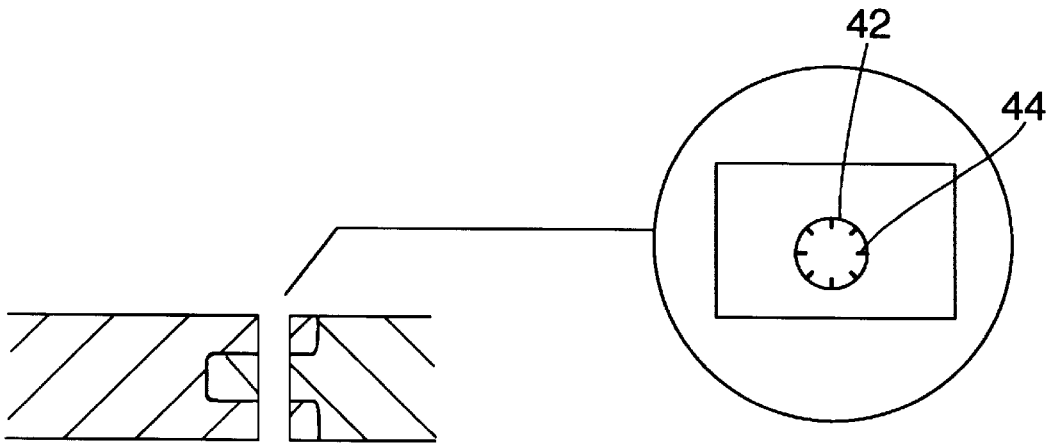
Fig. 7
Fig. 8
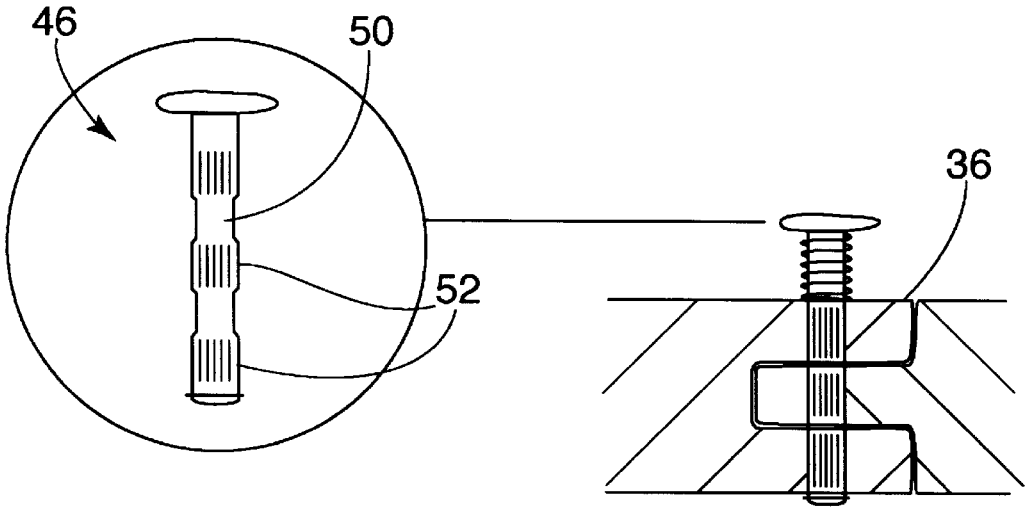
Fig. 10
Fig. 9

MULTI-POSITIONAL TURNING TOOL

BACKGROUND OF THE INVENTION

1. Field of the Invention

This invention is in the field of extendible hand tools which have interchangeable heads and pivoting shafts and are capable of adjustment in the position of the heads. The tools of this invention may have a handle at one end and a tool head at the other or they may be adapted to have a tool head at each end.

2. Description of the Related Art

The prior art is aware of tools having one or more of the above features.

Thus, U.S. Pat. No. 2,978,938 to Nalley describes a wrench having a handle with a telescoping sleeve for extension, a pivotable attachment between the upper and lower sections of the sleeve, and a pivotable attachment between the wrench head and the wrench handle. When the pivoting mechanisms are used, pivoting of the head and lower part of the handle is possible only along one plane (right or left as viewed in FIG. 2). Therefore, a full range of motion is not possible. While it is taught that the wrench handle is moveable in the sleeve for extension and retraction of the handle, no teaching is given as to how this is performed with the handle being held firmly in the desired position.

U.S. Pat. No. 4,901,608 to Shieh discloses a ratchet wrench with an adjustable angle between the head and the body. The wrench head pivots around a bolt and is held in the desired position by teeth in the extension of the head contacting gear teeth in the handle. In spite of the complexity of the device and need for small parts of complex shapes, the head may be made to pivot up and down as seen in FIG. 1 but cannot be made to pivot from side to side. Thus, the Shieh device has limited utility when used in hard-to-reach areas.

U.S. Pat. No. 5,109,737 to Raber discloses a hand tool, generically, and a ratchet wrench, particularly. The handle, containing a detent, fits into a sleeve provided with a plurality of spaced holes, thus allowing for easy extension and retraction of the handle. Extension and retraction may be achieved only when the detent is in line with a hole in the sleeve and thus the handle cannot be extended to every length which may be desired by the user.

U.S. Pat. No. 5,230,263 to Kwaka discloses a wrench which has a handle, a box wrench head fixed to one end of the handle, and a socket wrench head (with or without a ratchet mechanism) pivotally attached to the other end. The pivot mechanism is made up of a pin penetrating a lug protruding from the handle. The movement of the wrench head is frictionally restrained by the interaction of the several component members. Thus, this pivoting mechanism provides for only an up-and-down motion and does not provide for a side-to-side range of motion.

U.S. Pat. No. 5,280,740 to Ernst discloses a hand tool having a pivotal head attached to the shaft by a pin through holes in the head and a clevis in the shaft. The tool is rotatable about its axis. While the head may be made to pivot up and down, no provision is made to provide for a side-to-side pivot. Also, only a single pivoting point is present so that nuts or bolts which are hard to access may be unreachable with this tool.

U.S. Pat. No. 5,305,668 to Davis discloses a wrench with a plurality of pivotable links to enable access to areas which are hard to reach. This tool provides great side-to-side flexibility and is useful for those situations where a plurality of turns do not have to be made to access the nut or bolt. This tool does not provide for vertical flexibility, and thus finds little use in those circumstances where both vertical and horizontal bends must be made to reach hard-to-access nuts and bolts.

U.S. Pat. No. 5,331,869 to Webb discloses a wrench with interchangeable heads and a provision for pivoting the head up or down. No provision for side-to-side pivoting is made. Thus, while this tool finds limited improvement over non-pivoting wrenches, it leaves unmet the need to provide a fully flexible tool which can reach hard-to-access nuts and bolts.

U.S. Pat. No. 5,471,899 to Twomblow discloses an extendible wrench which provides a pivotable head. The head can pivot up or down, but lacks the ability to pivot from side to side. Thus, access to hard-to-reach nuts and bolts is limited.

U.S. Pat. No. 5,836,223 to Lin discloses a head having interchangeable tool pieces and a shaft which may be extended. No provision is made for pivoting the head of this tool. Thus, access to hard-to-reach areas is not provided for.

SUMMARY OF THE INVENTION

The present invention seeks to provide a turning hand tool with interchangeable tool pieces which avoids the disadvantages of the prior art tools while providing a tool which can gain access to hard-to-reach areas. In accomplishing these desired results, a plurality of pivotable parts is provided as well a tool piece which may be easily arranged in the horizontal or vertical position.

The tool of the present invention contains at least one tool piece which may comprise any common type of tuning tool, such as wrench, socket driver, or screw driver.

The tool piece pivots about an attachment clip by means of a locking trigger pin. The pin has alternating areas of toothed surfaces and smooth surfaces. Likewise, the inner surfaces of the apertures through the sides of the attachment clip and the protrusion of the tool head have alternating areas of toothed surfaces and smooth surfaces. When these toothed surfaces are not aligned, the tool head may pivot freely about the attachment clip. When these toothed surfaces are aligned, the tool head is grasped firmly by the attachment clip and slippage is prevented.

The attachment clip has a proximal protrusion which easily connects and disconnects with a pivotal end piece having an opening which has the same shape as the corresponding protrusion in the attachment clip.

The ability of the attachment clip and the pivotal end piece to have their relative positions changed allows the tool piece to pivot either horizontally or vertically, and a fill 180° range of motion is possible in either position.

In a first embodiment of this invention, the pivotal end piece is pivotally connected to the distal end of the extending arm by means of a locking trigger pin.

The proximal end of the extending arm is pivotally attached by a locking trigger pin to the distal end of the shaft.

The proximal end of the shaft ends at an opening which is the same size and shape as the opening in the pivotal end piece. This opening allows for the easy connection and disconnection of a second tool piece so that the position of the second tool piece may be varied relative to the shaft.

An outer cover is rotatably attached to the proximal end of the shaft. An inner unattached cover having a shoulder fits between the shaft and the outer cover.

When the inner cover is moved to its proximal position, the shoulder of the inner cover abuts with the distal end of the outer cover. In this position, the extending arm is exposed and may be positioned as desired by the user. Also, in this position, a turning force exerted on the outer cover causes the shaft to turn.

When the inner cover is moved to its distal position, the extending arm is covered and is held in a straight line by the inner cover. In this position, a turning force on the outer cover causes the shaft to turn.

If desired, the inner cover may be completely removed.

In a second embodiment of this invention, the tool contains a tool piece which is the same as the tool piece of the first embodiment. The tool piece is held by a pivotal end piece in the same manner as the first embodiment.

The pivotal end piece is pivotally connected by means of a locking trigger pin to the distal portion of the shaft in the same manner as the pivotal end piece is attached to the extending arm in the first embodiment.

The distal shaft portion is pivotally connected to the proximal shaft portion by means of a locking trigger pin.

The shaft portions are non-circular in shape and are preferably square in cross-section. The shaft portions fit into like-shaped bores in a casing and are fixed or released by a holding mechanism, preferably a set screw threaded through the casing.

The casing is permanently attached to a handle. In this way a turning force may be applied to the handle to transfer a turning force to the tool head or the handle may act as a lever to turn the tool head in any of its extended or pivoted positions. The handle contains an extension of the casing bore for holding the shaft.

As can been seen, both embodiments provide for ease of operation, flexibility, and access to hard-to-reach areas.

BRIEF DESCRIPTION OF THE DRAWING

FIG. 7 is cross-sectional view of the abutment of a notch and a protrusion showing an aperture.

FIG. 8 is an enlarged plan view of FIG. 7 showing teeth within the aperture.

FIG. 9 is an engaged view partly in cross-section, of the abutment of a notch and a protrusion showing a locking trigger pin in place.

FIG. 10 is an enlarged elevational view of a locking trigger pin.

DESCRIPTION OF THE PREFERRED EMBODIMENTS

Figure 1:
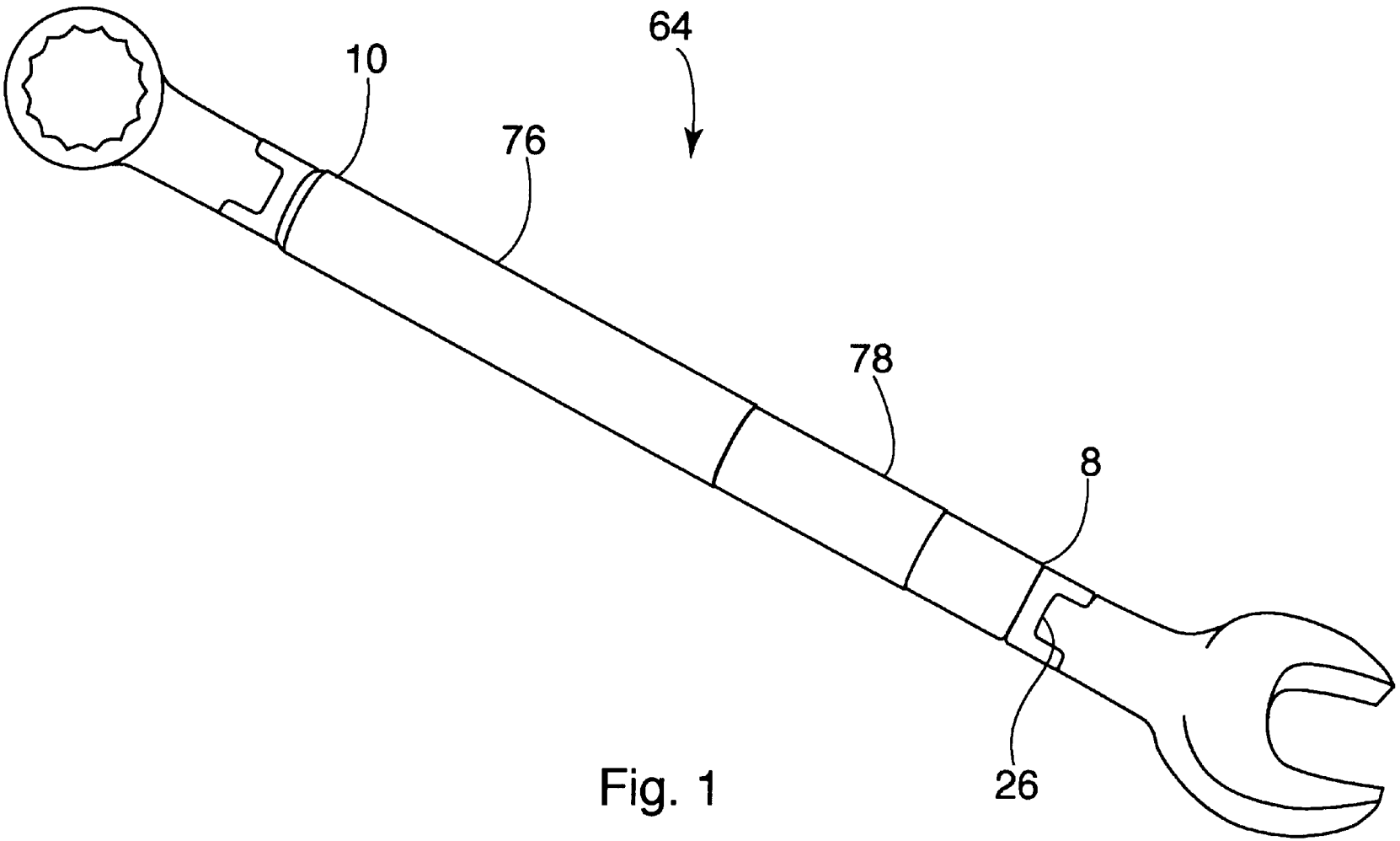
FIG. 1 is an elevational perspective view of a tool of the first embodiment of this invention.

The present invention contains two major embodiments. In the first embodiment there is a tool body 2 containing distal 4 and proximal 5 openings for receiving turning tool pieces 6 at each of the distal 8 and proximal 10 ends of the tool body 2. In the second embodiment there is a tool body 12 containing a distal opening 4 for receiving a tool pieces 6 at only one end.

Figure 3:
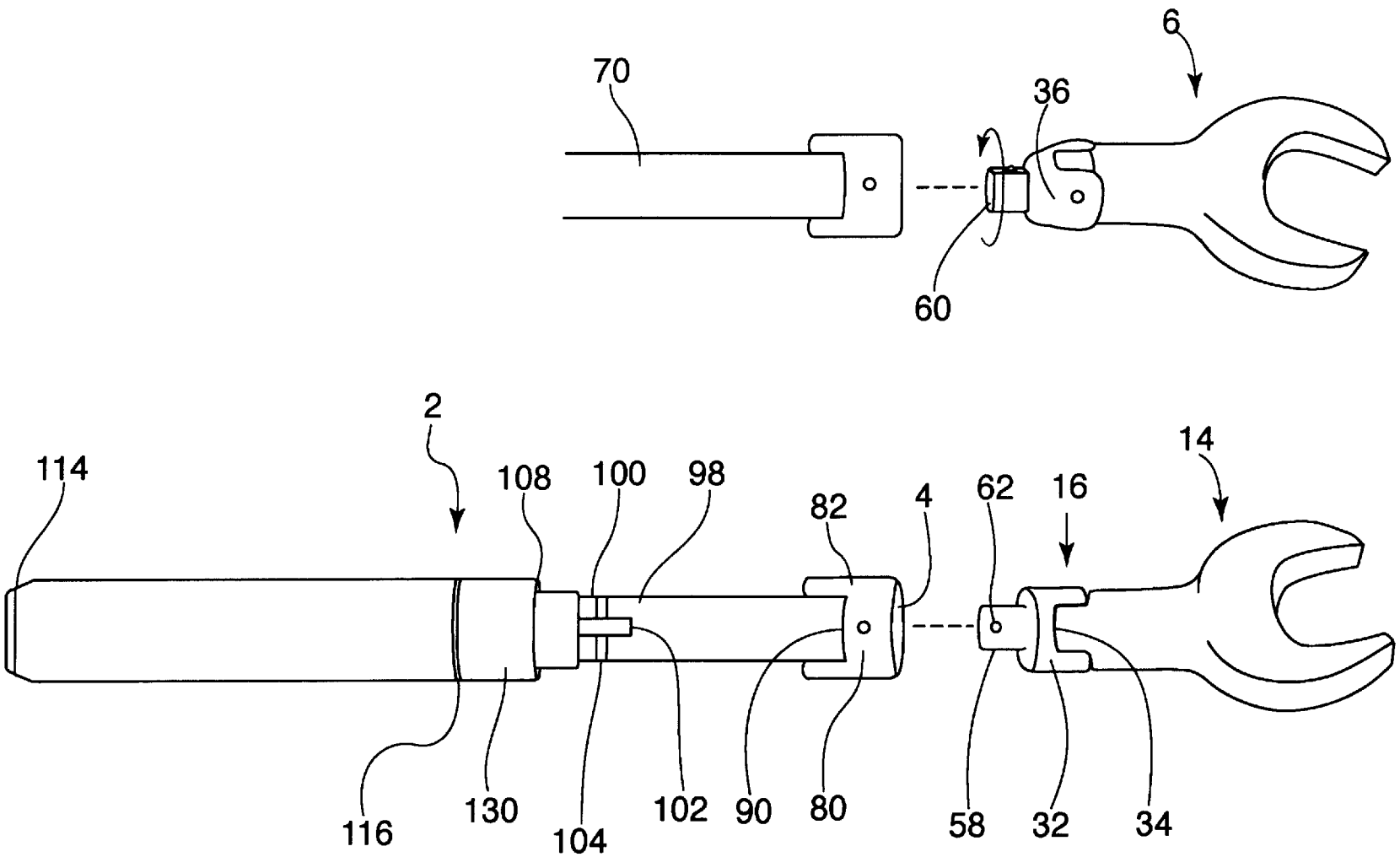
FIG. 3 is an elevational view showing the attachment of the tool piece to the pivotal end piece showing the ability of the position of the tool piece in relation to the pivotal end piece to be changed.
Figure 4:
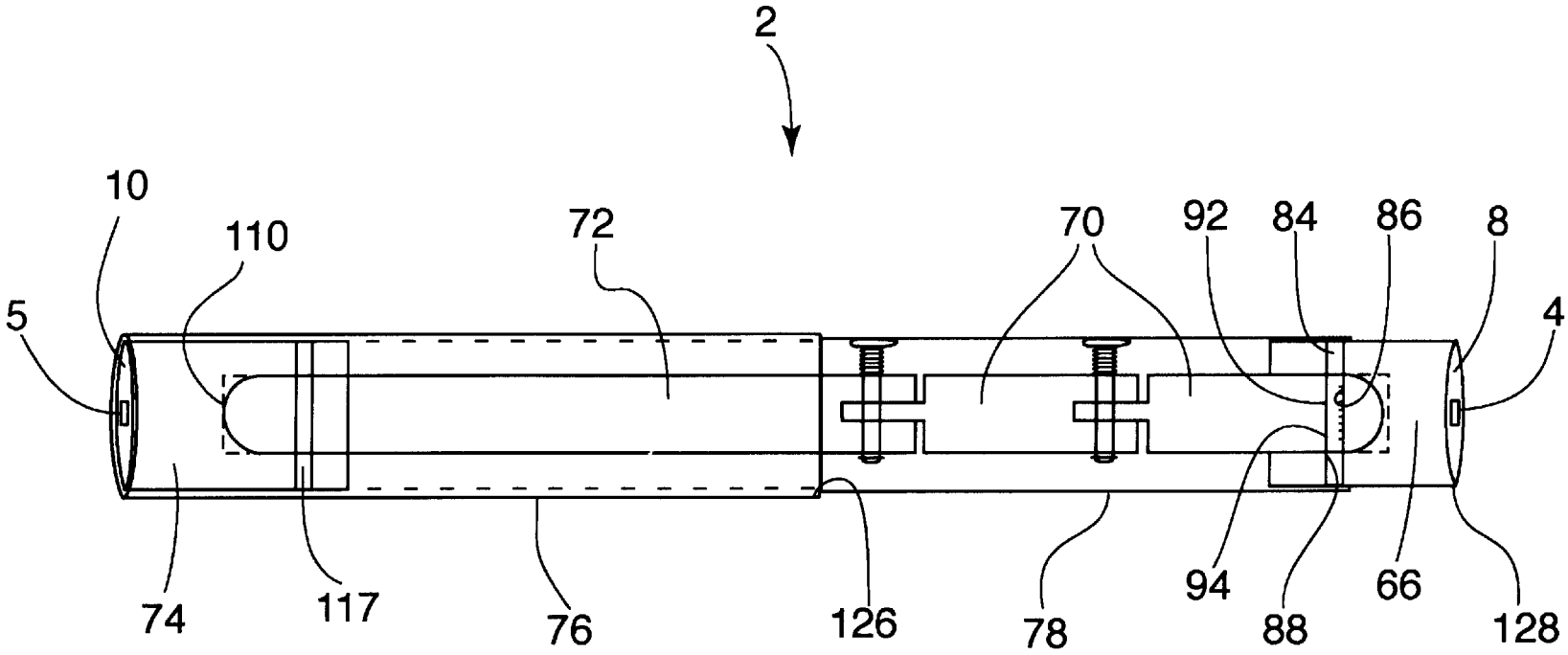
FIG. 4 is a schematic view of the tool body of the first embodiment of this invention.
Figure 5:
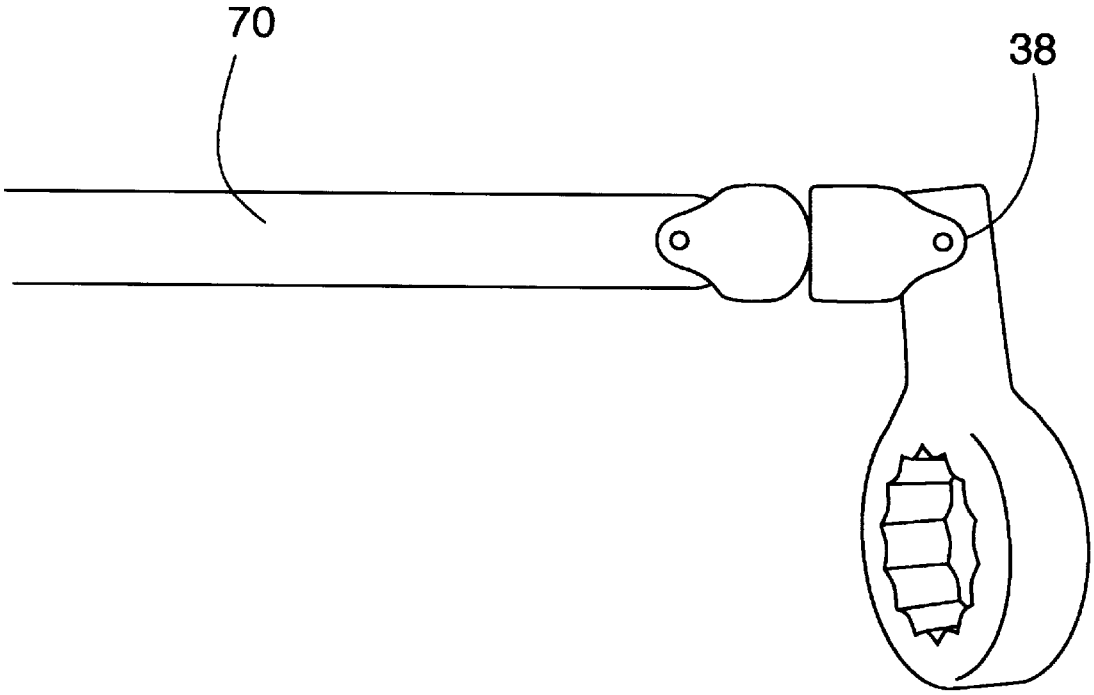
FIG. 5 is an elevational view showing the tool piece in a pivoted relationship to the pivotal end piece.
Figure 6:
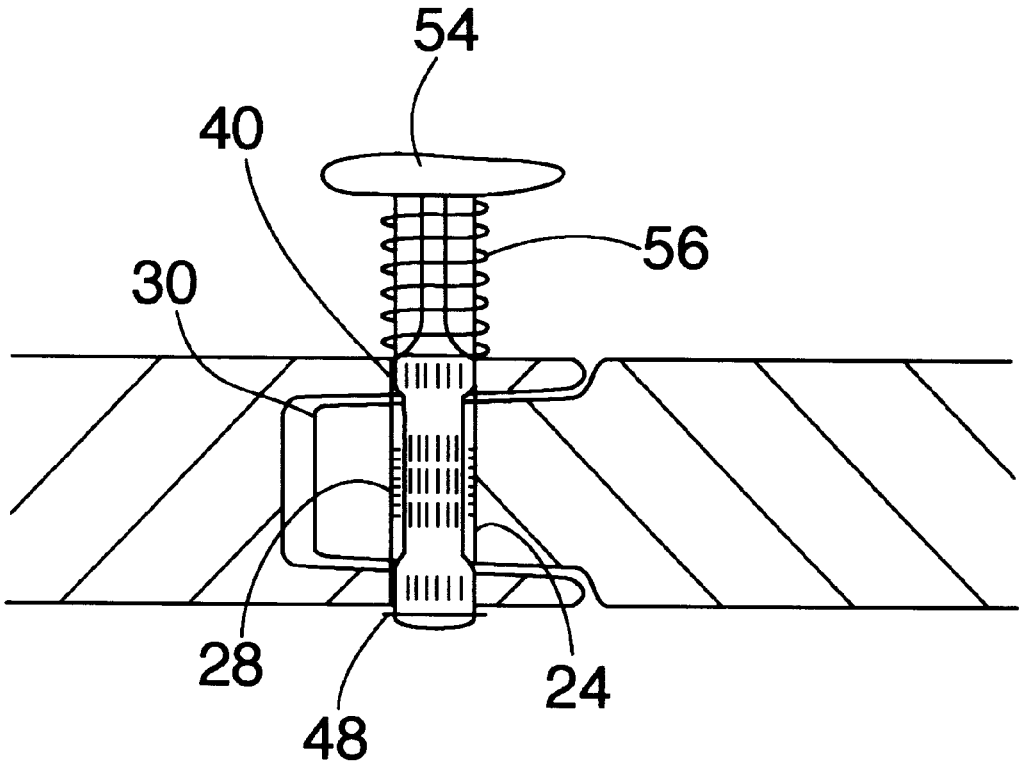
FIG. 6 is an enlarged view, partly in cross-section, showing the details of the locking trigger pin and its relationship to the apertures.

The tool piece 6 can be understood with reference to FIGS. 3–10.

The tool piece 6 is comprised of a tool head 14 and a connecting clip 16. The tool head 14 may comprise any conventional turning tool part 18, such as ratchet wrench, box wrench, socket wrench, Allen wrench, or screwdriver. The tool head 14 comprises a distal turning tool part 18, a central body 20 and a proximal protrusion 22. The protrusion 22 may be of any conventional regular shape, although a square cross-section is preferred. The protrusion 22 contains a circular aperture 24 which passes through the protrusion 22 parallel to the proximal end 26 thereof. The aperture 24 contains alternating toothed 28 and smooth 30 sections. The edges of the protrusion 22 parallel to the aperture 24 are rounded to allow for free movement relative to the connecting clip 16.

The connecting clip 16 contains a clevis 32 forming a notch 34 and two sides 36 at the distal end 38 thereof, which clevis 32 has a circular aperture 40 through each side 36 thereof. Each aperture 40 having an inner wall 42 containing teeth 44. A locking trigger pin 46 attaches the tool head 14 to the connecting clip 16 by fitting through the provided apertures 24 40.

The locking trigger pin 46 contains a holding clip 48 fixedly attached to the shaft 50 of the pin 46, a round shaft 50 containing a plurality of toothed sections 52 and having a diameter nearly equal to that of the apertures 24 40, a head 54, and a tension spring 56 which tends to push the head 54 away from the sides 36 of the clevis 32. When the locking trigger pin 46 is in place and the tool head 14 is in a fixed position, teeth 52 of the locking trigger pin 46 line up with teeth 28 44 in the apertures 24 40. When the head 54 of the locking trigger pin 46 is depressed, the sections of the shaft 50 having teeth 52 are pushed away from the sections of the apertures 24 40 which have teeth 28 44, allowing the protrusion 22 to easily pivot in the notch 34. When the head 54 of the locking trigger pin 46 is released, toothed sections 52 of the shaft 50 are brought back into contact with corresponding toothed sections 28 44 on the inner walls 42 of the apertures 24 40 in the sides 36 of the clevis 32 and in the protrusion 22. The protrusion 22 is thus grasped firmly in the notch 34 and pivoting is prevented. Other, conventional, holding rods may be used for the purpose of connecting the several sections of the tool of this invention. Such holding rods have a round crosssection to allow for free pivoting while anchoring in place can be accomplished by frictional connection between a square notch and a square protrusion.

The connecting clip 16 contains a proximal protrusion 58 of any conventional regular cross-section containing straight sides 60, although a square cross-section is preferred. One side 60 of the protrusion 58 contains a spring-tensioned ball 62 which allows quick and easy removal of the protrusion 58 from the appropriate opening 4 while maintaining sufficient pressure against the side of the opening 4 as to avoid accidental loss of the tool piece 6.

The above-described tool piece 6 is identical for all openings 4 of this invention and will be referred to throughout this specification simply as the tool piece 6.

Figure 2:
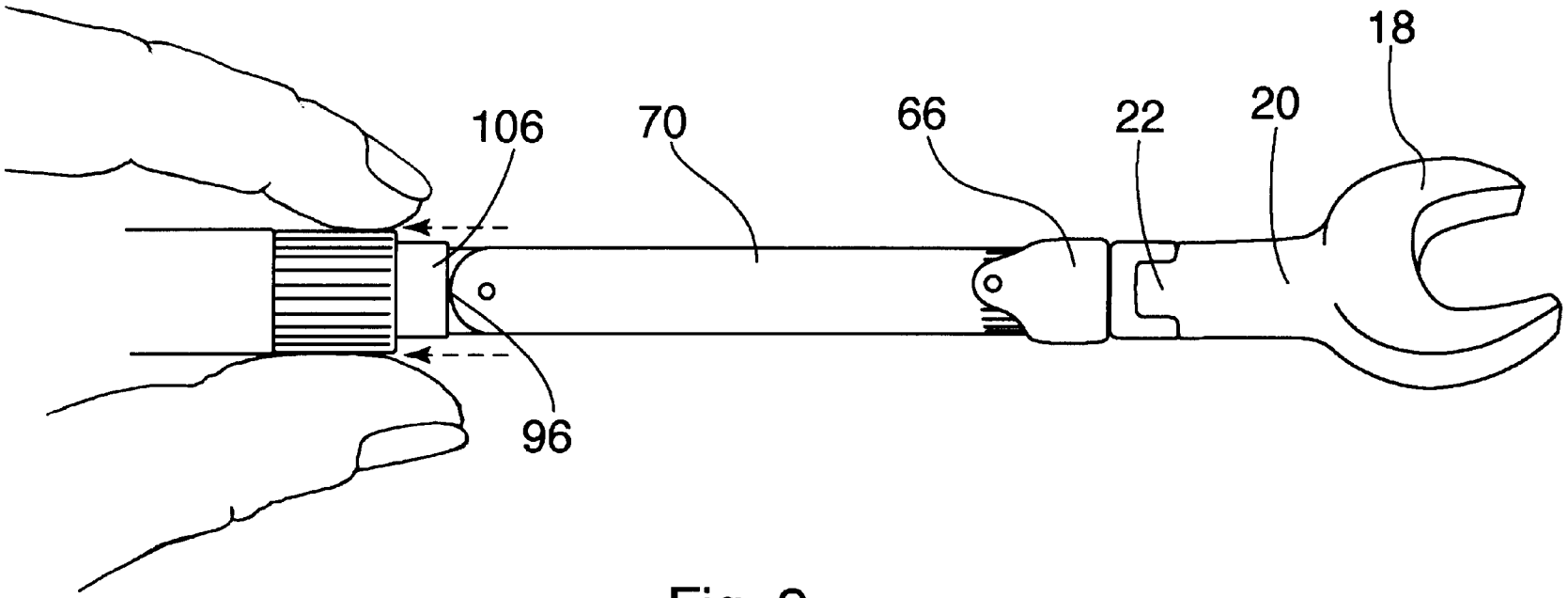
FIG. 2 is an elevational view of the distal end of a tool of this invention showing the extending arm.

Reference is made to FIGS. 1–10 to understand the first embodiment of this invention. In the first embodiment, the tool 64 comprises a tool body 2 and the above-described tool piece 6. The tool body 2 comprises a pivotal end piece 66 containing a distal first opening 4 for receiving the tool piece 6, at least one extending arm 70, a shaft 72 ending in a proximal second opening 5 for a second tool piece 6, a proximal end piece 74, an outer cover 76, and an inner cover 78.

The pivotal end piece 66 contains a distal opening 4 of the same shape as the protrusion 58 of the connecting clip 16. The pivotal end piece 66 contains a proximal clevis 80 containing sides 82 having circular apertures 84 therethrough which apertures 84 have teeth 86 on the inner walls 88.

Through quick, easy connection and disconnection between the tool piece 6 and the pivotal end piece 66, the tool piece 6 may be adjusted so as to have a horizontal or vertical positioning relative to the remainder of the tool 64. Thus, the tool piece 6 may pivot along the same plane as the remaining pivots or it may pivot along a plane 90° thereto when the cross-sections of the protrusion 22 and corresponding opening 4 are square. Other angles are possible when the protrusion 22 and opening 4 have other configurations, e.g., hexagon. This flexibility gives the tool 64 of the present invention its ability to be useful in hard-to-reach areas.

The pivotal end piece 66 contains a proximal clevis 80 containing sides 82 having circular apertures 84 therethrough. The pivotal end piece 66 is attached to the distal rounded end 90 of the extending arm 70 by a previously-described locking trigger pin 46 passing through these apertures 84 and an aperture 92 containing a plurality of toothed sections 94 through the extending arm 70 near the distal end 90 thereof The distal end 90 of the extending arm 70 is rounded for easy movement in connection with the pivotal end piece 66.

The extending arm 70 may be of any cross-sectional configuration, but for ease in manufacturing, a square cross-section is preferred.

The proximal end 96 of the extending arm 70 is rounded so as to provide ease of movement relative to the shaft 72. The proximal end 96 of the extending arm 70 forms a clevis 98 having sides 100 and a notch 102. The sides 100 have apertures 104 therethrough near the proximal end 96. The proximal end 96 of the extending arm 70 is pivotally attached to a protrusion 106 on the distal end 108 of the shaft 72 by means of a locking trigger pin 46 in the manner previously described. The extending arm 70 allows for a variety of positions of the tool piece 6 relative to the shaft 72 and also provides leverage capable of supplying increased force to nuts, bolts, screws, etc.

The shaft 72, preferably circular in cross-section, has a distal end 108 and a proximal end 110. The distal end 108 ends in a protrusion 106 which fits into the proximal clevis 98 of the extending arm 70.

The outer cover 76 has a proximal end 114 and a distal end 116 and is circular in cross-section. The shaft 72 is connected to the outer cover 76 by means of a set screw 117 near the proximal end 110 of the shaft. There is a proximal end piece 74 which is positioned between the shaft 72 and the outer cover 76. This proximal end piece 74 presents a second, proximal opening 5 which has the same size and shape as the opening 4 of the pivotal end piece 66. This opening 5 is suitable for holding a connecting clip 16 of a second tool piece 6.

The inner cover 78 has a proximal end 126 and a distal end 128. It, too, is circular in cross-section having a diameter slightly less than that of the outer cover 76. The inner cover 78 has a shoulder 130 having the same cross-section as the outer cover 76. Thus, the inner cover 78 may slide between a proximal, retracted position and a distal, extended position.

When the inner cover 78 is in the proximal position, the extending arm 70 is exposed and the extending arm 70 may be pivoted to any desired position, allowing the tool head 14 to reach hard-to-access areas. When the inner cover 78 is in the proximal position, the shoulder 130 of the inner cover 78 may be held and a turning force on the outer cover 76 results in a turning of the shaft 72.

When the inner cover 78 is in the distal position, the extending arm 70 is covered and is in line with the shaft 72. The shoulder 130 of the inner cover 78 may be held and a turning force applied to the outer cover 76. This results in a turning of the shaft 72.

Figure 11:
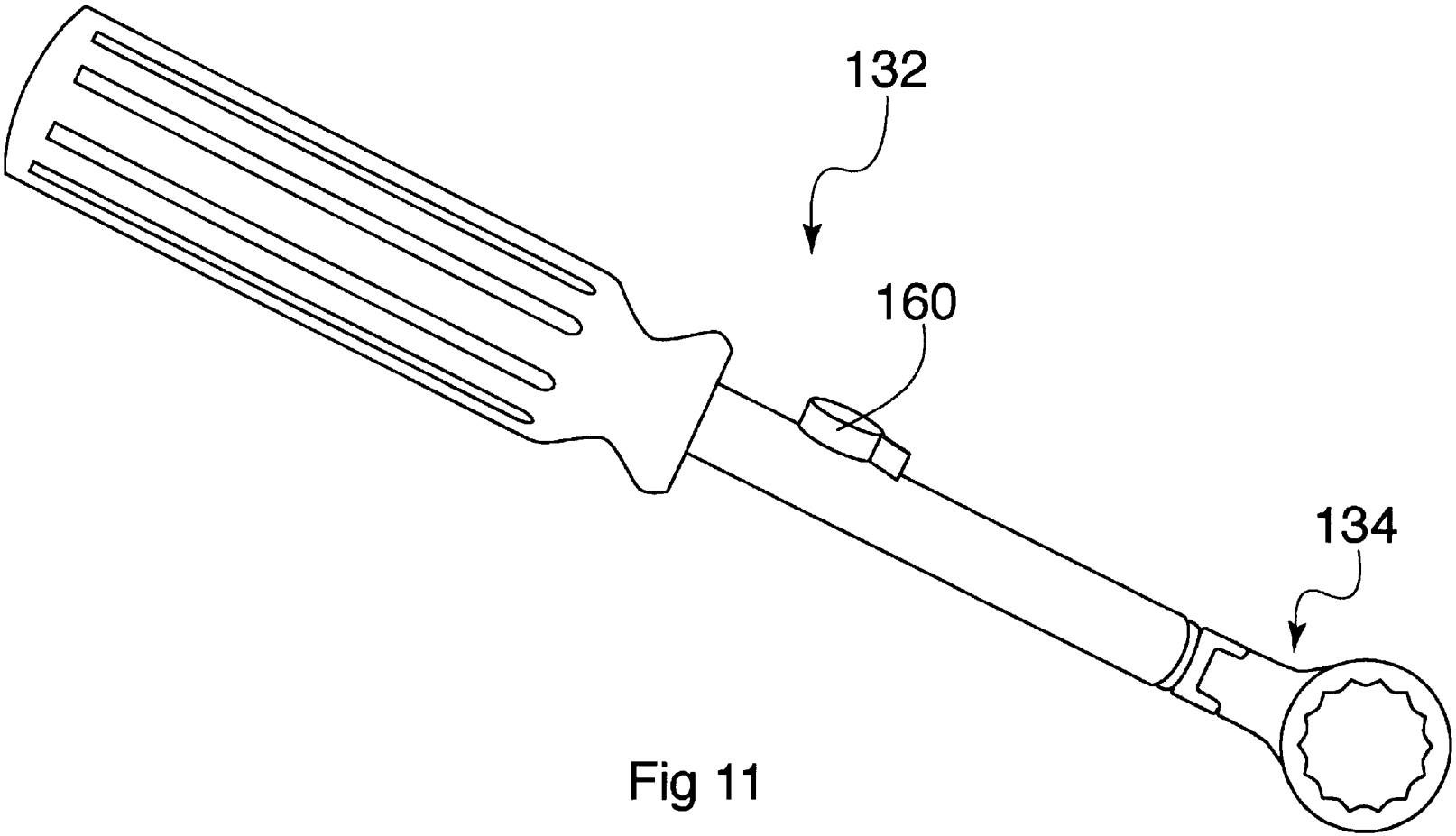
FIG. 11 is an elevational perspective view of a tool of the second embodiment of this invention.
Figure 12:
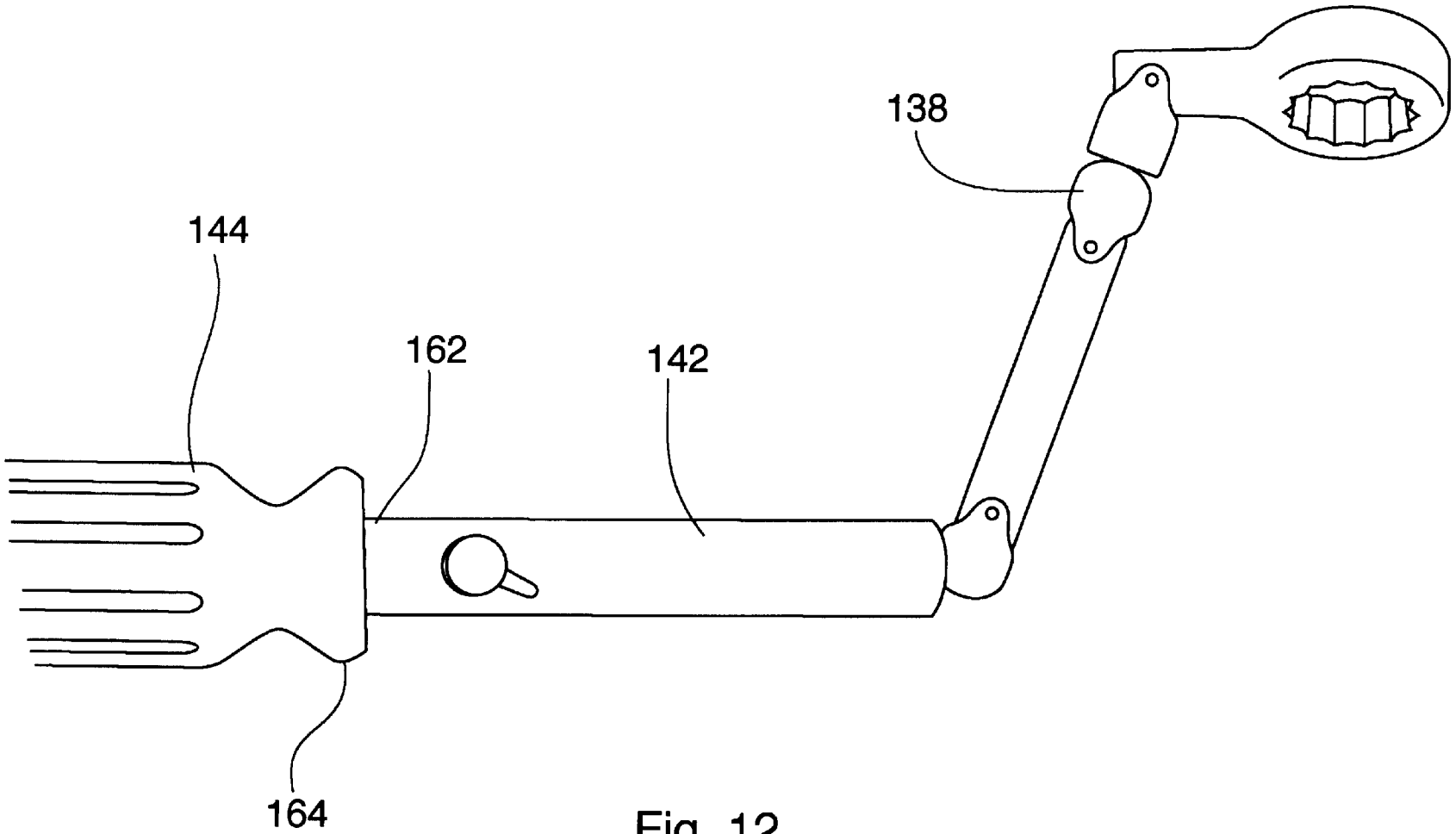
FIG. 12 is an elevational perspective view of a tool of the second embodiment of this invention with the distal portion of the shaft extended showing pivotal possibilities.
Figure 13:
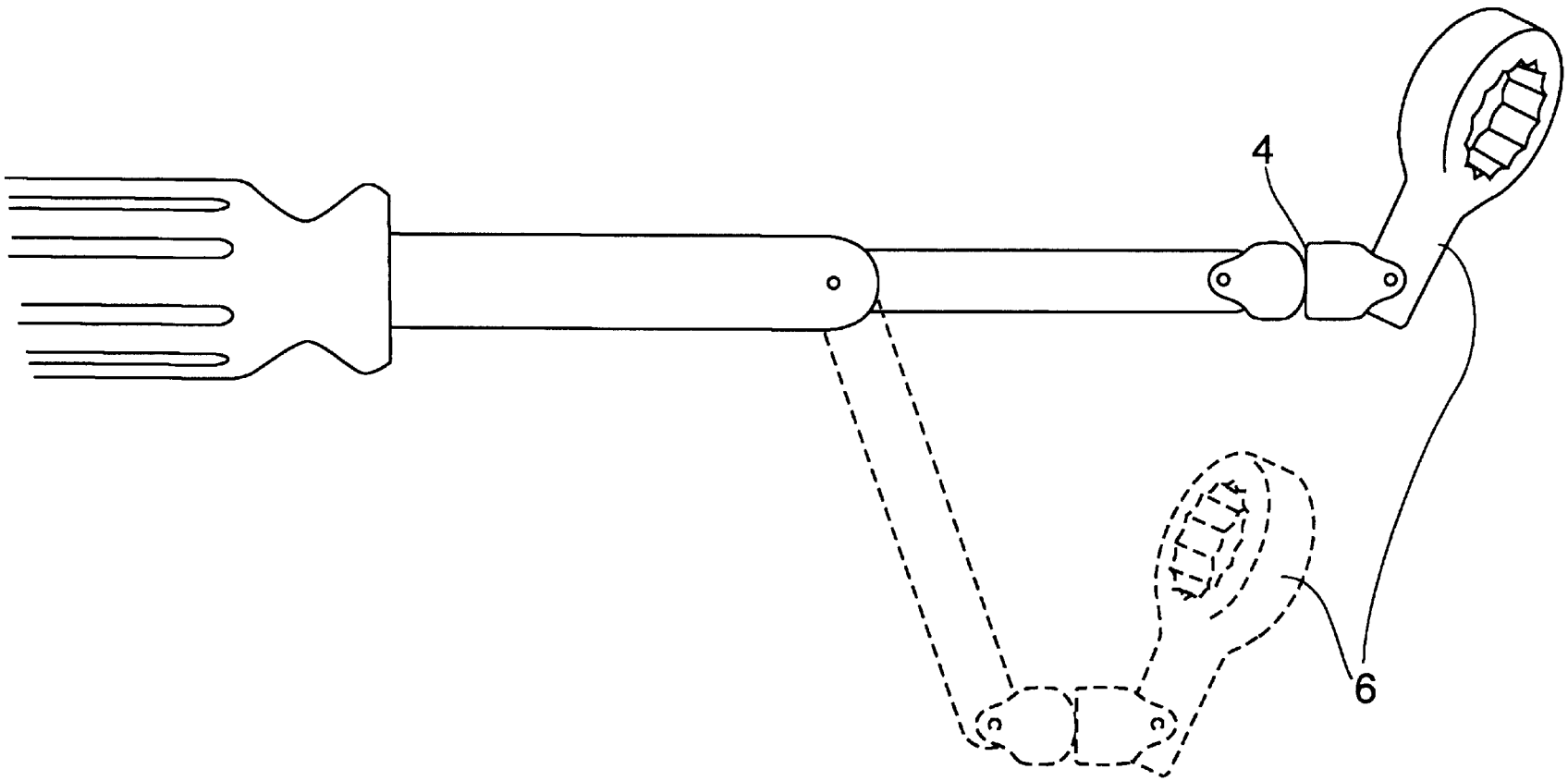
FIG. 13 is an elevational perspective view of a portion of a tool of the second embodiment of this invention with the proximal and distal portions of the shaft extended showing additional pivotal possibilities.
Figure 14:
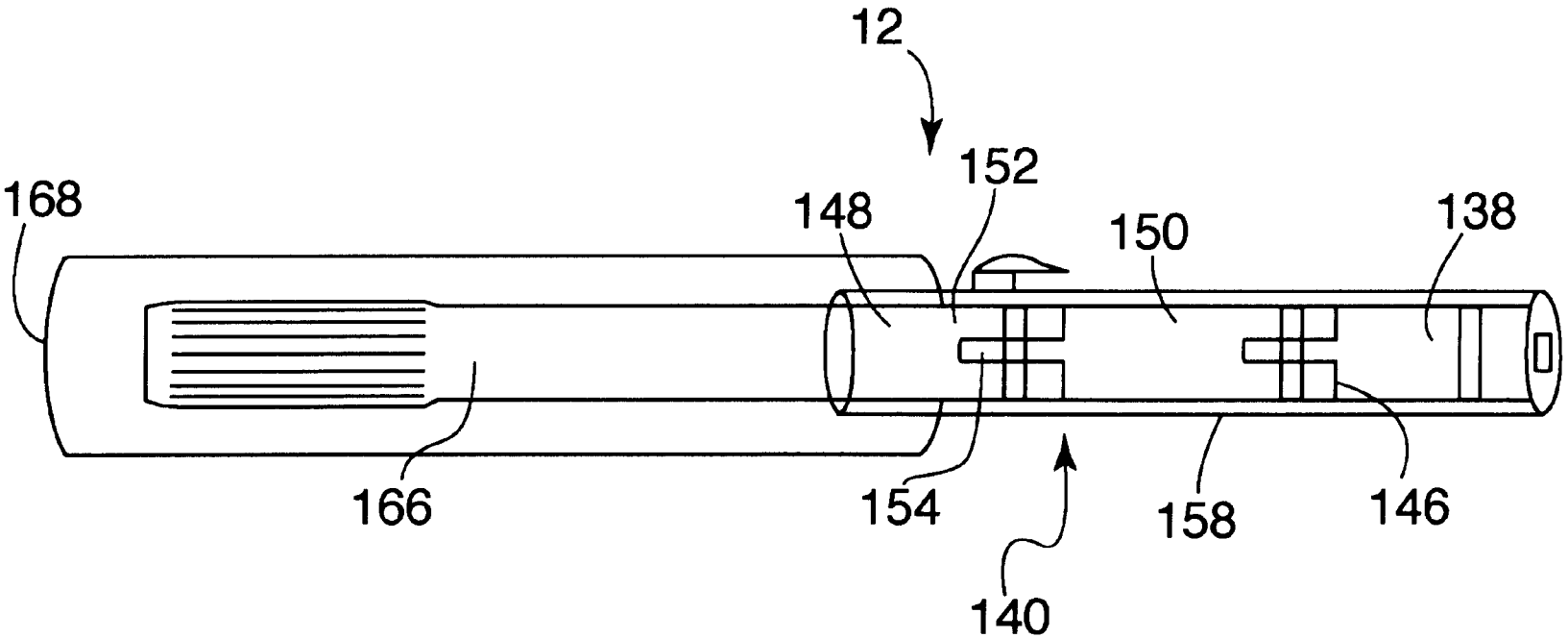
FIG. 14 is a schematic view of the tool body of the second embodiment of this invention.

With reference to FIGS. 6–14, the second embodiment of the invention will now be described.

The tool 132 of the second embodiment comprises the tool piece 134 and a body 12 comprising a pivotal end piece 138, a segmented pivoting shaft 140, a casing 142, and a handle 144.

The tool piece 134 is the same as that which has been previously described.

The pivotal end piece 138 is the same as the pivotal end piece 66 of the first embodiment.

The pivotal end piece 138 is attached to the distal end 146 of a shaft 140 in the same fashion as previously described in the first embodiment for attaching the pivotal end piece 66 to the extending arm 70. The shaft 140 has a rounded distal end 146 to allow free movement between the shaft 140 and the pivotal end piece 138. The shaft 140 has a proximal portion 148 and a distal portion 150. These two portions 148 150 are connected by means of a clevis 152 on a first portion (148 or 150), a protrusion 154 on a second portion (148 or 150), and a locking trigger pin 46 extending through apertures 24 40 passing therethrough in the manner previously described.

The segmented shaft 140 fits into a like-shaped bore 158 in the casing 142. The shaft 140 may be in a fully retracted proximal position or a fully extended distal position or any place between these two positions. A set screw 160 positioned on the casing 142 may be easily adjusted to tighten and hold the shaft 140 in the desired position or loosened to allow the shaft 140 to be moved.

The proximal end 162 of the casing 142 abuts with the distal end 164 of the handle 144. The handle 144 has a hollow bore 166 having the shape of the shaft 140 so that the proximal end 156 of the shaft 140 may extend to a point just distal to the proximal end 168 of the handle 144. In this way, full use of the length of the tool 132 is made in providing a shaft 140 with a plurality of segments 148 150 which can extend beyond the distal end 170 of the casing 142. This extension ability is of assistance in reaching nuts and bolts in hard-to-access areas.

Although the invention has been described and illustrated in detail, it is to be clearly understood that the same is by way of illustration and example, and is not to be taken by way of limitation. For example, it is apparent that the positioning of devises and protrusions may be switched at will. The spirit and scope of the present invention are to be limited only by the terms of the appended claims.

I claim:

1. A tool piece comprising a tool head for connecting directly with the material to be worked on and a pivotably connecting clip, wherein the tool head comprises a distal turning tool part, a central part, and a proximal protrusion which is pivotably connected to the connecting clip and wherein the pivotably connecting clip has a proximal protrusion having a square cross-section for fitting into a tool handle, one side of the protrusion containing a spring-loaded ball, and wherein the pivotable connection between the tool head and the connecting clip is such that the tool head contains a protrusion which pivots in a notch of the connecting clip, which notch is formed from a clevis containing two sides, which clevis has a circular aperture though each side thereof and protrusion of the tool head has a circular aperture therethrough, each aperture in each clevis having a toothed circumference and the aperture in the protrusion of the tool head containing alternating toothed and smooth sections.

2. The tool piece of claim 1 wherein, a locking trigger pin passes through the apertures of each side of the clevis and the protrusion of the tool head, which locking trigger pin comprises a round shaft containing a plurality of toothed sections and has a diameter nearly equal to that of the apertures, a head, and a tension spring which tends to push the head away from the side of the clevis.

3. A tool body comprising:

A) a pivotal end piece having a distal opening,

B) an extending arm having a proximal end and a distal end, the distal end being pivotably attached to the pivotal end piece, C) a shaft having a proximal end and a distal end, the distal end being pivotably attached to the proximal end of the extending arm, D) an outer cover having a proximal end and a distal end, said outer cover being attached near its proximal end to the shaft near its proximal end, E) a proximal end piece positioned between the proximal end of the shaft and the outer cover, which proximal end piece presents an opening having the same dimensions as those of the pivotal end piece, and F) an inner cover having a shoulder which abuts with the outer cover, which inner cover is positioned between the shaft and the outer cover and may be longitudinally moved to expose or conceal the extending arm.

4. A tool comprising a tool body comprising:

A) a pivotal end piece having a distal opening,

B) an extending arm having a proximal and a distal end, the distal end being a pivotably attached to the pivotal end piece, C) a shaft having a proximal end and a distal end, the distal end being pivotably attached to the proximal end of the extending arm, D) an outer cover having a proximal end and a distal end, said outer cover being attached near its proximal end to the shaft near its proximal end, E) a proximal end piece positioned between the proximal end of the shaft and the outer cover, which proximal end piece presents an opening having the same dimensions as those of the pivotal end piece, and F) an inner cover having a shoulder which abuts with the outer cover, which inner cover is positioned between the shaft and the outer cover and may be longitudinally moved to expose or conceal the extending arm having attached thereto a tool piece having a tool head and a pivotably connecting clip, which pivotably connecting clip has a proximal protrusion having the same shape as the opening of the pivotal end piece.

5. The tool of claim 4 wherein, the tool head comprises a distal turning tool part, a central body and a proximal protrusion which is pivotably connected to the connecting clip.

6. The tool of claim 5 wherein, the connecting clip contains a proximal protrusion having a square cross-section, one side of the protrusion containing a spring-tensioned ball.

7. The tool of claim 6 wherein, the pivotable connections between (i) the tool head and the connecting clip, (ii) the pivotable end piece and the distal end of the extending arm, and (iii) the proximal end of the extending arm and the distal end of the shaft are such that the tool head contains a protrusion which pivots in a notch of the connecting clip, the distal end of the extending arm pivots in a notch in the pivotal end piece, and the distal end of the shaft provides a protrusion which pivots in a notch in the proximal end of the extending arm.

8. The tool of claim 7 wherein, each notch is formed from a clevis containing two sides, which clevis has a circular aperture through each side thereof and each end or protrusion has a circular aperture therethrough, each aperture in each clevis having a toothed circumference and each aperture in the ends or protrusions containing alternating toothed and smooth sections.

9. The tool of claim 8 wherein, a locking trigger pin passes through the apertures of each set of notches and clevises to pivotally connect the tool sections, which locking trigger pin comprises a round shaft containing a plurality of toothed sections and has a diameter nearly equal to that of the apertures, a head, and a tension spring which tends to push the head away from the sides of the devices.

10. A tool body comprising:

A) a pivotal end piece having a distal opening,

B) a segmented pivoting shaft having a proximal portion and a distal portion, which portions are pivotally connected, each portion having a proximal end and a distal end, C) a casing having a proximal end and a distal end, which casing contains a bore having a cross-sectional shape which is the same as that of the shaft, said casing containing the pivoting shaft which is capable of longitudinal movement in the casing and a mechanism for holding and releasing the shaft in the casing to prevent and allow longitudinal movement of the shaft in the casing, and D) a handle which contains a bore having a cross-sectional shape which is the same as that of the shaft.

11. A toot comprising a tool body comprising:

A) a pivotal end piece a distal opening,

B) a segmented pivoting shaft having a proximal portion and a distal portion, which portions are pivotally connected, each portion having a proximal end and a distal end, C) a casing having a proximal end and a distal end, which casing contains a bore having across-sectional shape which is the same as that of the shaft, said casing containing the pivoting shaft which is capable of longitudinal movement in the casing and a mechanism for holding and releasing the shaft in the casing to prevent and allow longitudinal movement of the shaft in the casing, and D) a handle which contains a bore having a cross-sectional shape which is the same as that of the shaft having attached thereto a tool piece having a tool head and a pivotably connecting clip, which pivotably connecting clip has a proximal protrusion having the same shape as the opening of the pivotal end piece.

12. The tool of claim 11, wherein the tool head comprises a distal turning tool part, a central body and a proximal protrusion which is pivotably connected to the connecting clip.

13. The tool of claim 12 wherein, the connecting clip contains a proximal protrusion having a square cross-section, one side of the protrusion containing a spring tensioned ball.

14. The tool of claim 13, wherein the pivotable connections between (i) the tool head and the connecting clip, (ii) the pivotable end piece and the distal end of the distal portion of the shaft, and (iii) the proximal end of the distal portion of the shaft end the distal end of the proximal portion of the shaft are such that the tool head contains a protrusion which pivots in a notch of the connecting clip, the distal end of the distal portion of the shaft pivots in a notch in the pivotal end piece, and the proximal end of the distal portion of the shaft contains a protrusion which pivots in a notch in the distal end of the proximal portion of the shaft.

15. The tool of claim 14 wherein, each notch is formed from a clevis containing two sides, which clevis has a circular aperture through each side thereof and each protrusion or end has a circular aperture therethrough, each aperture in each clevis having a toothed circumference and each aperture in each protrusion or end containing alternating toothed and smooth sections.

16. The tool of claim 15 wherein, a locking trigger pin passes through the apertures of each clevis and each protrusion or end to pivotally connect the tool sections, which locking trigger pin comprises a round shaft containing a plurality of toothed sections and has a diameter nearly equal to that of the apertures, a head, and a tension spring which tends to push the head away from the sides of the clevises.

* * * * *

UNITED STATES PATENT AND TRADEMARK OFFICE

CERTIFICATE OF CORRECTION

PATENT NO. : 6,186,033
DATED : February 13, 2001
INVENTOR(S) : Faro

It is certified that error appears in the above-identified patent and that said Letters Patent is hereby corrected as shown below:

col 2, line 34, replace "tuning" with --turning--.

col 2, line 52, replace "fill" with --full--.

col 4, line 62, replace "crosssection" with --cross-section--.

col 7, line 5, replace "devices" with --clevises--.

claim 1, line 13, thereof, replace "though" with --through--.

claim 11, line 1, replace "toot" with --tool--.

claim 11, line 8 thereof, replace "across-sectional" with --a cross-sectional--.

Signed and Sealed this

Fifth Day of June, 2001

Nicholas P. Godici

NICHOLAS P. GODICI

*Acting Director of the United States Patent and Trademark Office*

*Attest:*

*Attesting Officer*